US005551728A

United States Patent [19]

Barthel et al.

[11] Patent Number: 5,551,728

[45] Date of Patent: Sep. 3, 1996

[54] GLIDING BOARD

[75] Inventors: Fritz Barthel, Haering; Josef Dummer, Innsbruck, both of Austria

[73] Assignee: silvretta-sherpas Sportartikel GmbH, Rothschwaige, Germany

[21] Appl. No.: 279,658

[22] Filed: Jul. 25, 1994

[30] Foreign Application Priority Data

Jul. 23, 1993 [DE] Germany ..... 43 24 871.3

[51] Int. Cl.[6] ..... A63C 5/16

[52] U.S. Cl. ..... 280/818; 280/14.1; 280/14.2

[58] Field of Search ..... 280/14.1, 14.2, 280/15, 609, 815, 816, 818, 845, 602, 607, 608, 617, 633; 441/73

[56] References Cited

U.S. PATENT DOCUMENTS

| | | | |
|---|---|---|---|
| 1,565,945 | 12/1925 | Leslie . | |
| 2,918,293 | 12/1959 | Tavi | 280/602 |
| 4,817,988 | 4/1989 | Chauvet et al. | 280/817 |

FOREIGN PATENT DOCUMENTS

| | | | |
|---|---|---|---|
| 0430805 | 6/1991 | European Pat. Off. | 280/818 |
| 2523670 | 9/1983 | France . | |
| 2564000 | 11/1985 | France . | |
| 2579474 | 10/1986 | France | 280/607 |
| 2611345 | 9/1988 | France . | |
| 2616341 | 12/1988 | France | 280/818 |
| 2630339 | 10/1989 | France . | |
| 2628333 | 11/1989 | France . | |
| 8903154 | 6/1989 | Germany . | |
| 9209879 | 9/1992 | Germany . | |
| 661875 | 8/1987 | Italy | 280/818 |

*Primary Examiner*—Richard M. Camby
*Assistant Examiner*—Frank Vanaman
*Attorney, Agent, or Firm*—McAulay Fisher Nissen Goldberg & Kiel

[57] ABSTRACT

A gliding board, in particular a snowboard, which is formed by two skis and a central part connected by fittings, has a clamping device in the central region. The skis can be clamped against one another by the clamping device accompanied by deformation in the transverse direction so that the gliding board can be adjusted to a desired sidecut radius.

17 Claims, 10 Drawing Sheets

FIG. 7
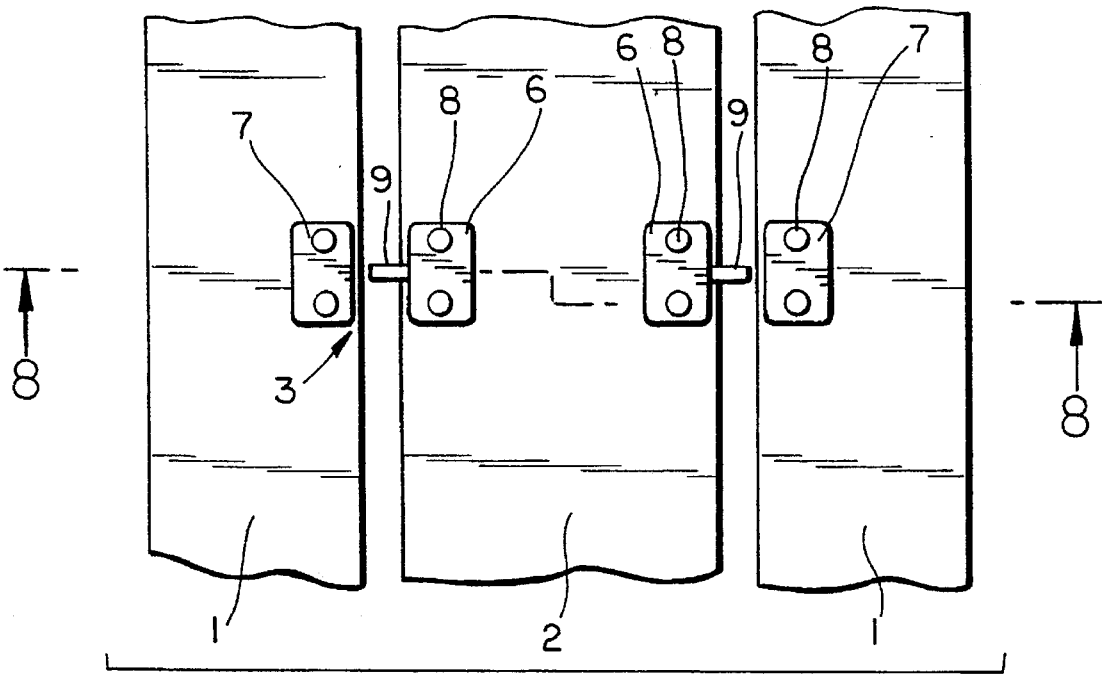
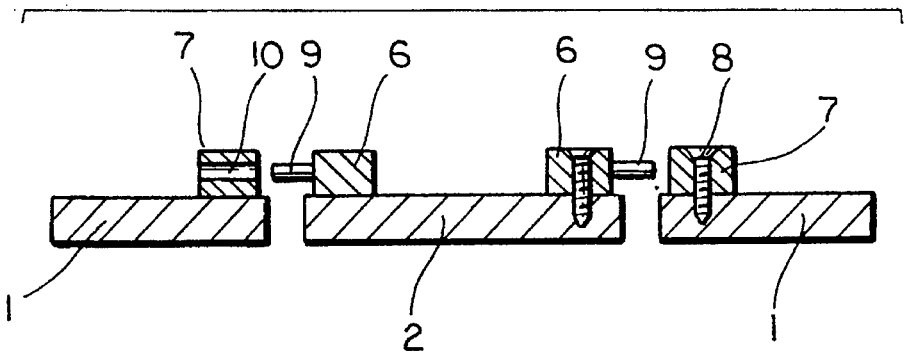
FIG. 8

FIG. 14
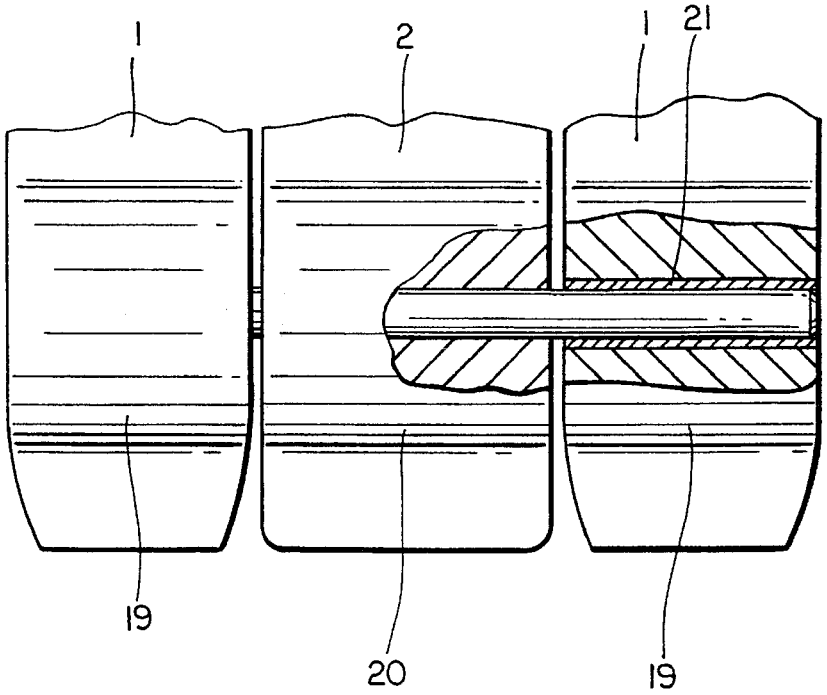
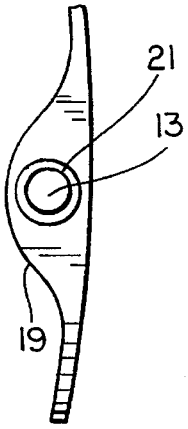
FIG. 15
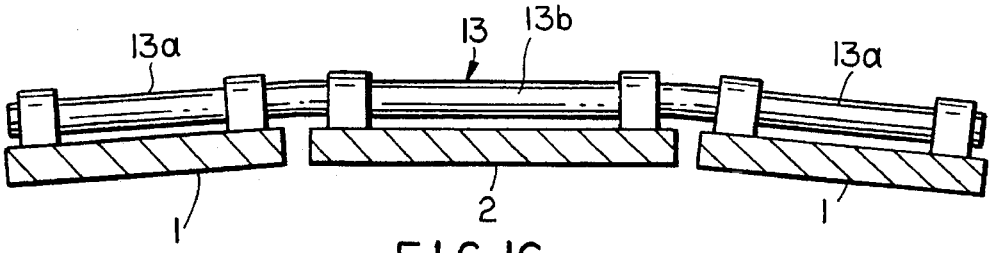
FIG. 16
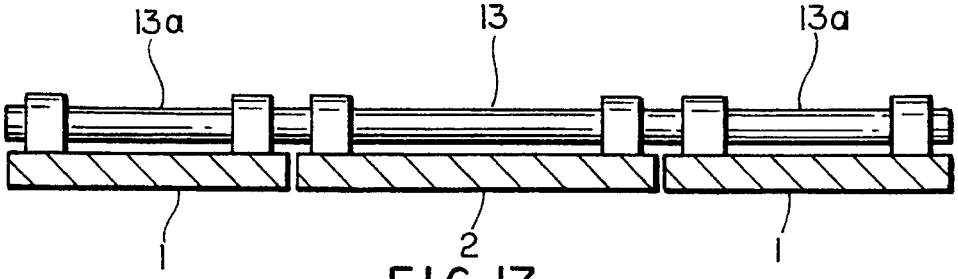
FIG. 17

GLIDING BOARD

BACKGROUND OF THE INVENTION a) Field of the Invention

The invention is directed to a gliding board, in particular, a snowboard having two skis, in particular cross-country skis or touring skis, and hardware or fittings for connecting the touring skis.

b) Description of the Related Art

In cross-country skiing, snow conditions do not always permit downhill running with touring skis or greatly impede downhill skiing. Snowboards are substantially better suited for this purpose, but cannot be used for moving uphill without external assistance, e.g. ski lifts. For this reason, there is a demand for sporting equipment which is constructed in at least two parts, which parts can be used as skis, especially touring skis, when separated and as a snowboard in the assembled state.

A problem with the known snowboard which is assembled from commercial skis, e.g. as known from DBGM 89 03 154, consists in that the sidecut radius of the skis is so different from that of conventional snowboards that the assembled snowboard cannot be used for carving turns. In skis the sidecut radius is approximately 40 m, while in snowboards it is roughly 8 to 12 m.

OBJECT AND SUMMARY OF THE PRESENT INVENTION

The primary object of the present invention is to provide a gliding board, in particular a snowboard, based on commercially available skis, especially touring skis, which conforms in the assembled state to the requirements commonly set for snowboards with respect to the sidecut radius and in which the skis, when disconnected, nevertheless retain the characteristics proper to a ski, especially a touring ski, particularly as regards sidecut radius and hardness.

This object is met in accordance with the invention in that, in a gliding board in the form of a snowboard having a longitudinal axis and having two touring skis, and fittings for connecting the skis with one another, the improvement comprises clamping means for connecting the two skis at least in a central region so that the two skis can be clamped together accompanied by deformation in a direction transverse to the longitudinal axis and so that fixed distances may be adjusted between the skis at least in the region of the tips of the skis and the ends of the skis.

Through the use of clamping means by which the skis can be clamped together in the central region accompanied by deformation in the transverse direction, the gliding board which is assembled in this way obtains at both sides the sidecut radii conventionally found in snowboards. Since the skis are held at a distance from one another in this way at least in the region of their ends, the forces acting on the individual skis when turning or cornering are so high that the action of the skis is no longer hard because they are now part of a snowboard covering a large surface area and lacking a central part or having a central part comprising one or more parts which are only capable of absorbing small forces so that the forces which, in a snowboard, would otherwise be distributed to the central part as well must now be absorbed by both skis.

In order to enable optional adjustment of the sidecut radius in an economical manner, it is advantageously provided in a further construction of the invention that an optional distance may be adjusted between the skis by means of fittings and that the taper or sidecut of the gliding board or snowboard is adjustable while at least partially retaining the distance between the skis. In this way, sufficient clearance may be left between the skis and central part from the start so as to allow a change in the sidecut radius to be carried out subsequently.

In a further development of the invention, a simple method for quickly producing a reliable connection between the two skis without impairing the adjustability of the sidecut radius is achieved in that the fittings comprise clips or sleeves arranged in the region of the tips of the skis and in the region of the ends of the skis and have connection rods which penetrate the clips or sleeves and which, when inserted in the clips, prevent a difference in height between the skis when the latter are connected with one another but allow the relative distance between the individual skis to be adjusted freely.

An optional distance can be adjusted between the skis in a simple manner according to the invention in that the clips are constructed as clamping clips and can be clamped on the connection rods.

Another possibility for adjusting the distance consists in providing fixed or adjustable stops on the connection rods. While both the clamping clips and the adjustable stops allow the distance to be changed in a continuous manner, it is necessary when fixed stops are provided on the connection rods to exchange these stops before changing the distance.

Although the skis can be connected at a relative distance from one another in principle, a further development of the invention advisably provides that a central part which has one or more parts and is divided transversely or longitudinally can be inserted between the two skis. This central part, with the exception of the regions associated with the tips and ends of the skis, is shaped in such a way that when the skis contact the central part at both end regions there remains a gap widening from both ends toward the center of the ski.

This gap is necessary for tightening the skis so as to adjust the desired sidecut radius. The central part is advisably shaped in such a way that the gap is closed in the tightened state of the skis, i.e. the skis have the desired sidecut radius when contacting the central part. This results in a gliding board or snowboard with a continuously closed gliding surface.

Ordinarily, based on the existing sidecut radius in the skis, it is sufficient according to another advantageous construction of the invention that the central part is adapted to the shape of the tips of the skis in the front region and to the shape of the ends of the skis in the rear region and that the region located between the latter has parallel defining edges so that the required sidecut radius can be achieved by tightening the touring skis until full contact is made with the central part.

On the other hand, if this sidecut radius should still not satisfy certain preferences regarding the running characteristics of the gliding board or snowboard, it is advisably provided in another construction of the invention that the central part is adapted to the shape of the ski tips in the front region and to the shape of the ski ends in the rear region and the region located between the latter is tapered. In this way a more pronounced sidecut can be effected.

According to the invention, a particularly simple step for connecting the central part with the skis consists in that the central part has fittings for receiving the connection rods.

In order to connect the skis and the central part in their central region in a simple manner in such a way that there is no difference in height between these parts, another advantageous construction of the invention provides insertable connections in the central region of the skis and central part which prevent a difference in height between the interconnected parts in the assembled state but allow the relative distance between the skis and central part to be adjusted freely.

In another construction of the invention, the fittings can be embedded in the skis and/or in the central part for a more attractive appearance.

If the skis are provided with simple clips or sleeves which do not allow clamping on the connection rod, the connection rods can be advantageously fastened to the central part in another construction of the invention. This eliminates the possibility of losing the connection rods when the gliding board is not in the assembled state.

Provided that the central part is sufficiently stable, it can serve as a spacer for the skis, in particular for touring skis.

Depending on the hardness or rigidity of the skis, high tensions caused by the clamping means can result in deformations such that the skis deflect upward with reference to the horizontal support plane, which results in a convex running surface since the outer edges deflect upward. In order to prevent this phenomenon or for deliberate adjustment of a determined convex, planar or concave running surface, it is provided in another construction of the invention that the connection rods are bent or angled at the regions associated with the skis. When the gliding board, in particular the snowboard, is tensioned by means of the clamping means, the bent regions are deformed as a result of the forces leading to the deformations described above, wherein these bent regions oppose the deformation forces in a resilient manner. Given a suitable selection of the bending angle of the outer regions of the connection rods and corresponding alignment of these regions, it is possible to adjust any desired gliding surface shape of the snowboard, i.e. a convex, flat or concave surface.

A clamping lock is preferably used as clamping means.

The skis, in particular touring skis, can also be arranged so as to be offset relative to one another in the longitudinal direction, resulting in an asymmetrical gliding board or snowboard.

In the following, the invention is explained more fully with reference to embodiment examples shown in the drawings.

BRIEF DESCRIPTION OF THE DRAWINGS

In the drawings:

FIG. 7 illustrates a top view of a section from the central part of the snowboard provided with fittings;

FIG. 8 illustrates a section according to line VIII—VIII in FIG. 7;

FIG. 14 illustrates a top view of the rear end of a modified gliding board;

FIG. 15 illustrates a side view of the end of the gliding board according to FIG. 14;

FIG. 16 illustrates a section through a snowboard in the region of the modified connection rod before the snowboard is tightened;

FIG. 17 illustrates a sectional view according to FIG. 16 in the tightened state of the snowboard.

DESCRIPTION OF THE PREFERRED EMBODIMENTS

Figure 18:
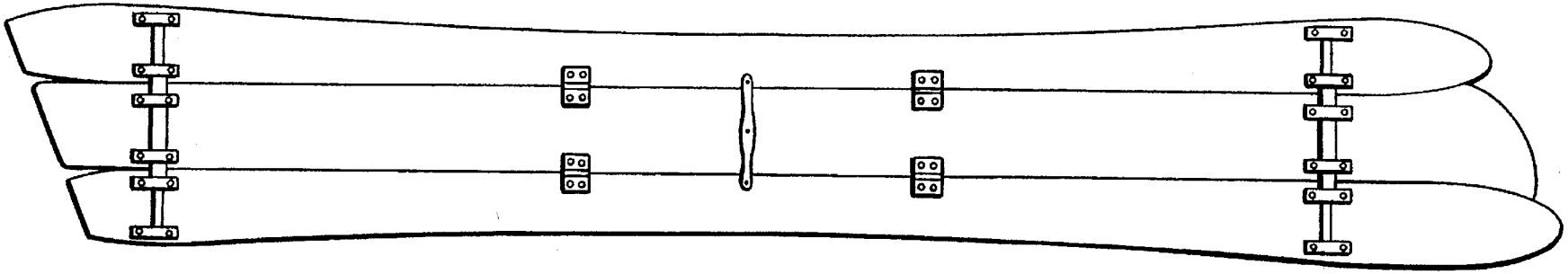
FIG. 18 illustrates a top view of an asymmetrically constructed gliding board or snow board.

The gliding board or snowboard shown in the drawing, in both the symmetrical construction according to FIGS. 1 to 17 and the asymmetrical construction according to FIG. 18, has two commercial skis 1, in particular touring skis, and a central part 2 which essentially serves only as a filling piece. The skis 1 and central part 2 are connected with one another by fittings 3 and 4 in such a way that a difference in height between the connected parts is prevented, while clamping means, designated by 5, clamp the skis against the central part so as to hold the individual parts together in the lateral direction without requiring additional holding means in the transverse direction.

As will be seen particularly from FIGS. 7 and 8, the fittings 3 have base parts 6 and 7 which are fastened in the edge region of the skis and central part by screws 8. The base part 6 carries a pin 9 which engages in a bore hole 10 in the base part 7 when assembling the individual parts. This prevents a difference in height between the adjoining parts without impeding their relative displacement in the horizontal direction.

Figure 1:
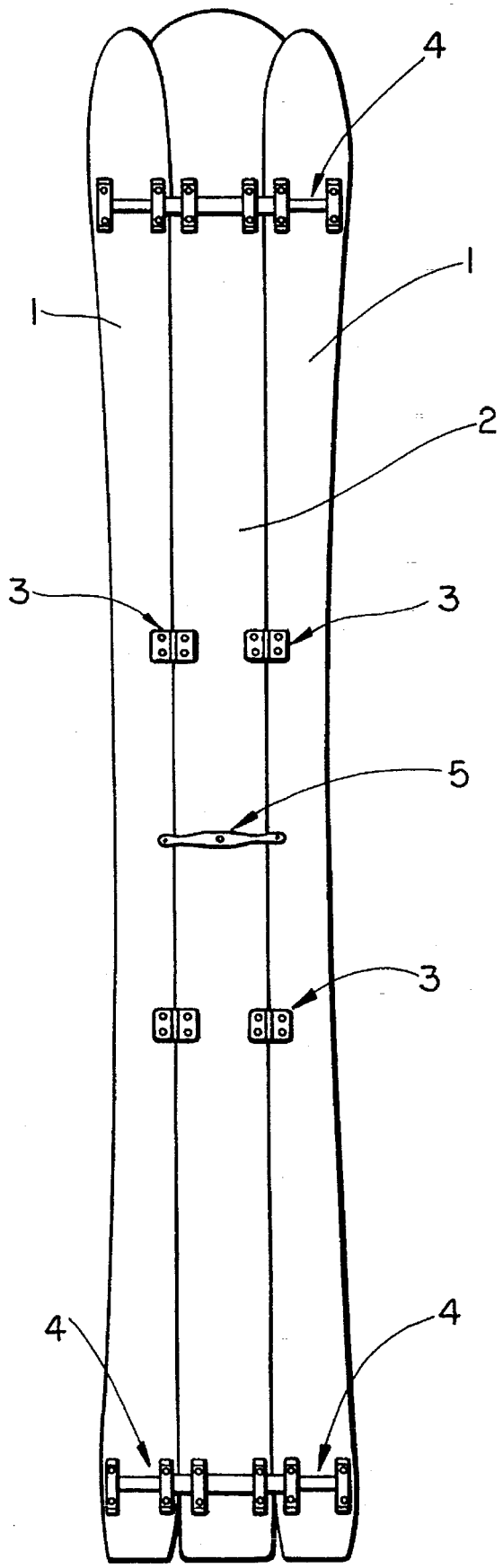
FIG. 1 illustrates a top view of an assembled snowboard.
Figure 2:
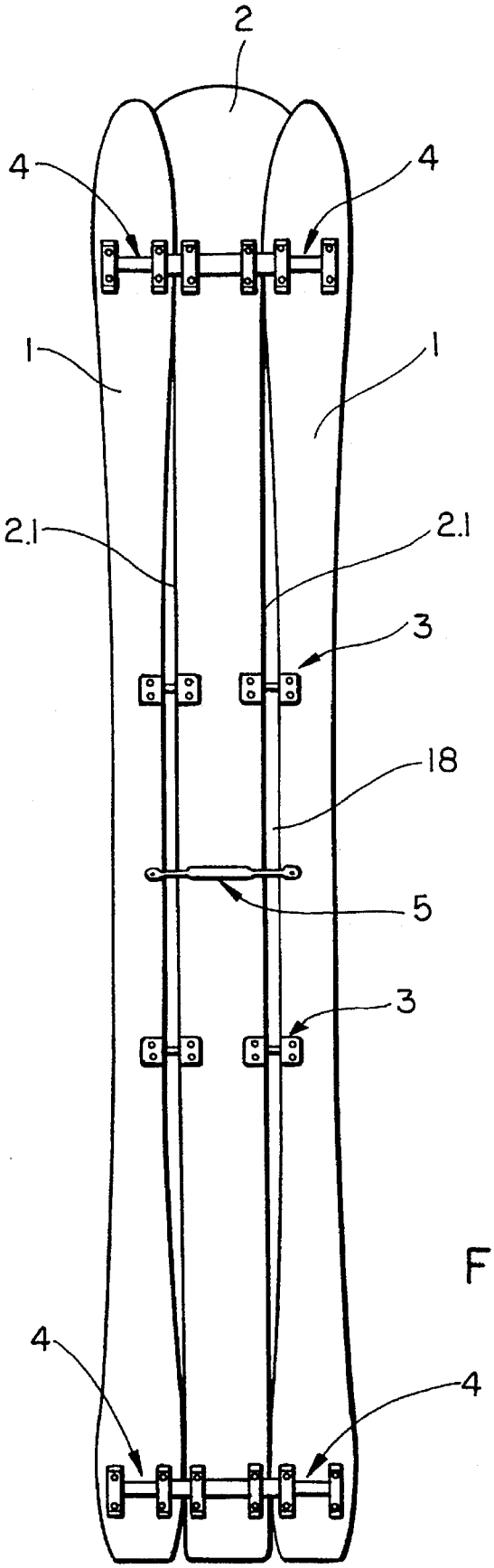
FIG. 2 illustrates the snowboard according to FIG. 1 before tightening the skis.
Figure 3:
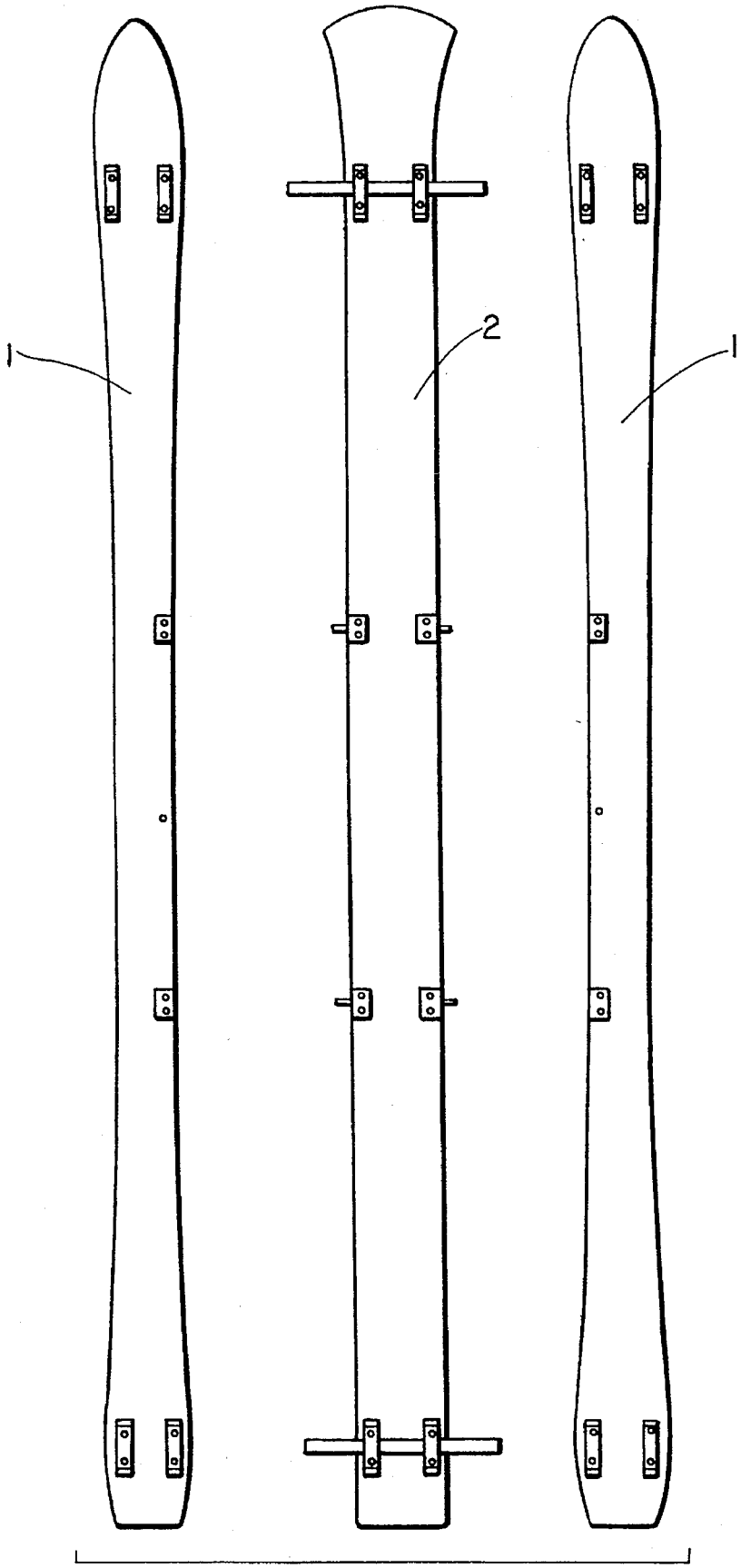
FIG. 3 illustrates skis and central part of the gliding board or snowboard prior to assembly.
Figure 4:
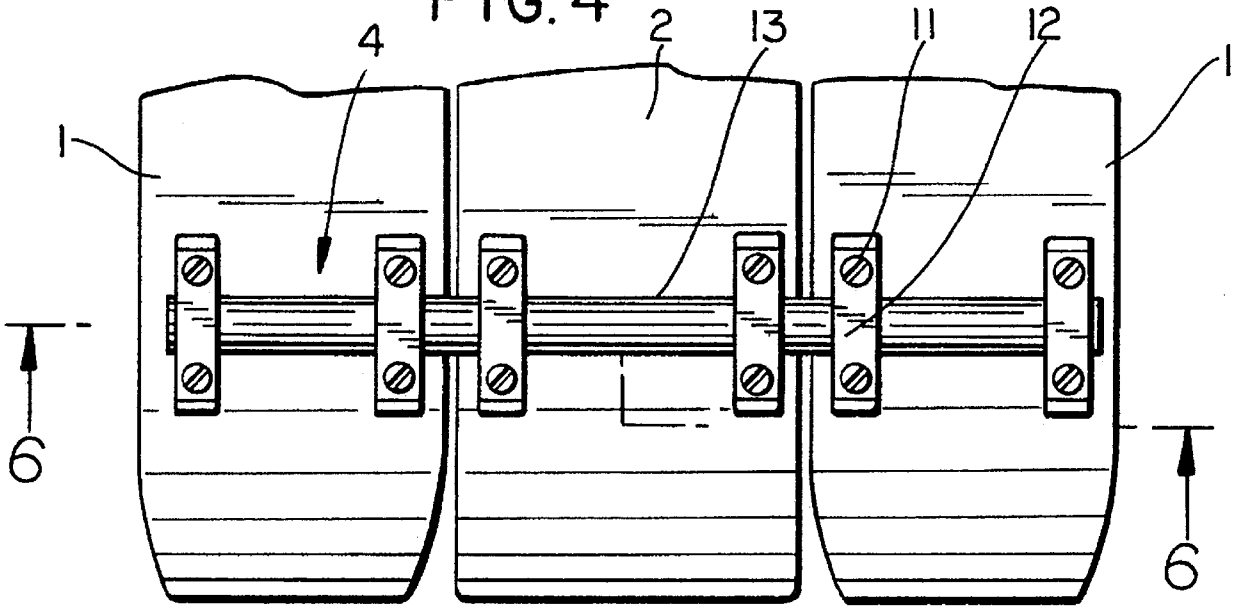
FIG. 4 illustrates a top view of the rear end of the gliding board or snowboard provided with fittings.
Figure 5:
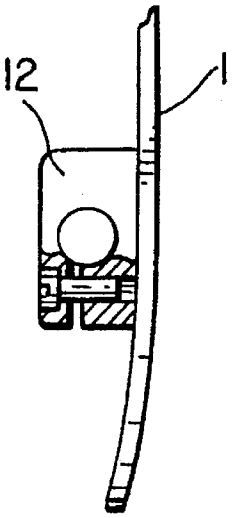
FIG. 5 illustrates a side view of the rear end of the snowboard according to FIG. 4.
Figure 6:
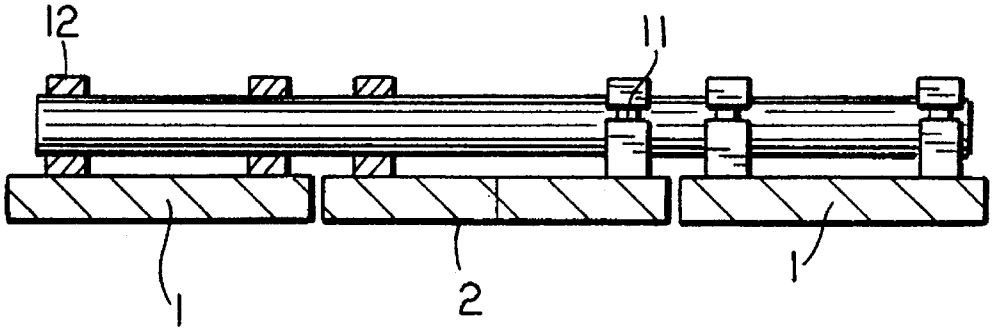
FIG. 6 illustrates a section according to line VI—VI in FIG. 4.

As will be seen, e.g., from FIGS. 4 to 6 which show a first embodiment form of such fittings, the fittings 4 have clamping clips 12 which can be fastened on the skis and on the central part by means of screws 11 and a connection rod 13 which can be inserted through the clamping clips 12. These connection rods 13 prevent a difference in height between the adjoining parts, but allow a lateral displacement in the horizontal direction. The clamping clips, whose construction is shown in FIG. 5, can be fastened anywhere along the connection rod so that the relative distance between the skis, and accordingly the relative distance from the central part, can be adjusted.

Figure 9:
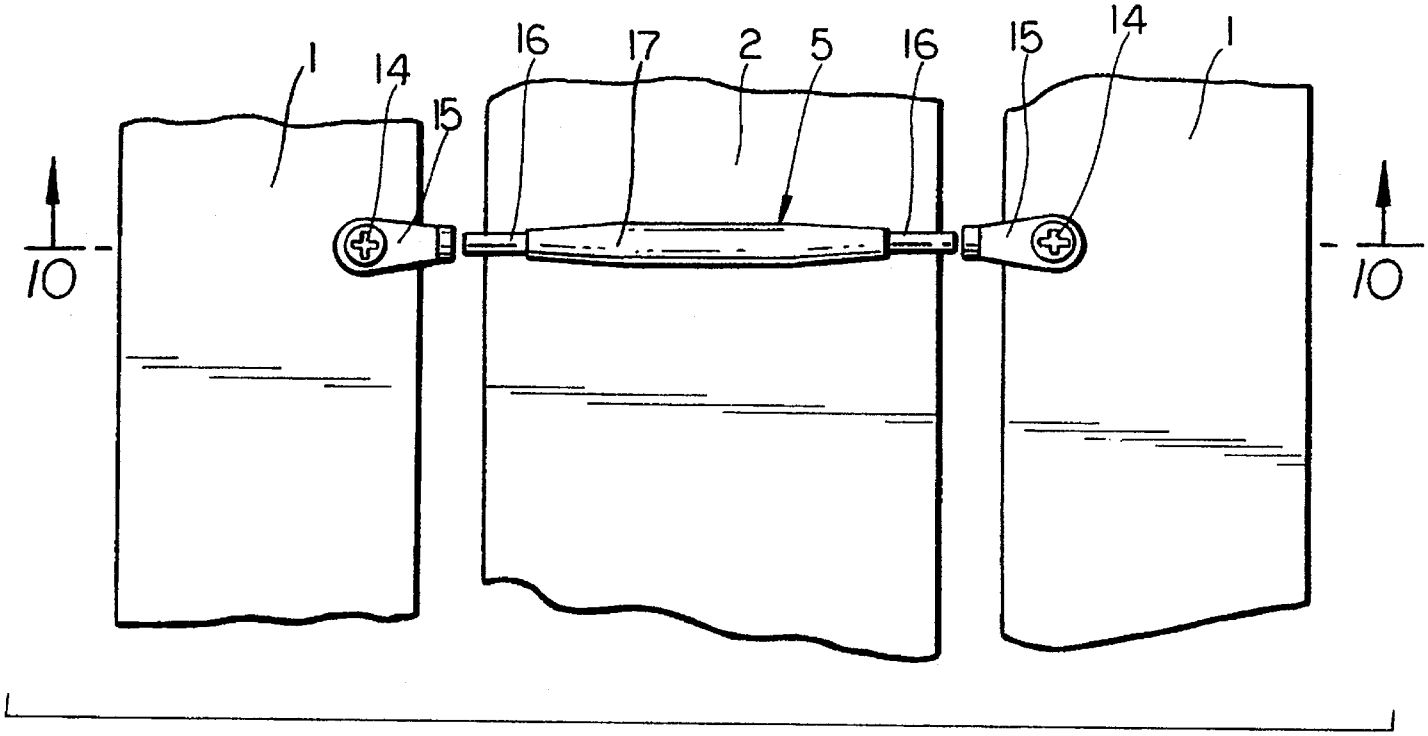
FIG. 9 illustrates a top view of a section from the central part of the snowboard provided with clamping means.
Figure 10:
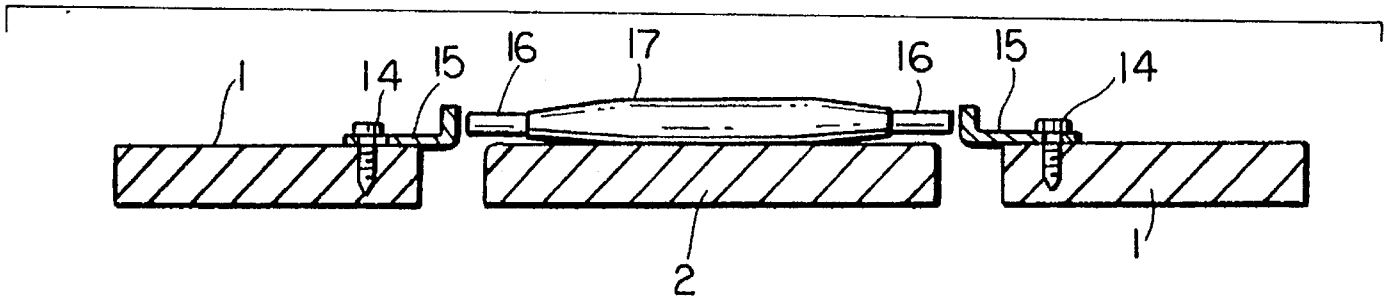
FIG. 10 illustrates a section according to line X—X in FIG. 9.

Clamping means 5 in the form of a clamping lock are provided in the center of the gliding board or snowboard for connecting the skis and central part and realizing the intended deformation of the skis for adjusting a desired sidecut radius. Reference is made to FIGS. 9 and 10 in particular. This clamping lock has two threaded bolts 16 which are fastened to the ski by means of screws 14 and by means of angle pieces 15 and a threaded sleeve 17 which is screwed onto the two threaded bolts 16 by threads working in opposite directions. Since the threaded bolts 16 are fastened only to the skis and the threaded sleeve 17 spans the central part 2, the two skis 1 can be clamped together in the direction of the central part accompanied by deformation in the transverse direction by turning the threaded sleeve 17 in the appropriate direction as will be seen by comparing FIGS. 1 and 2.

In this embodiment example, the central part 2 is adapted to the shape of the tips of the skis in the front end region and, for the rest, has parallel defining edges 2.1. Due to the sidecut radius of the skis, there is a gap, designated by reference number 18 in FIG. 2, which widens from the ends of the skis toward the center. When the two skis are clamped together by the clamping means 5, the gap 18 becomes increasingly smaller as the skis are deformed in the transverse direction until this gap disappears completely when the skis fully contact the central part. As a result of this tightening and deformation of the skis, the finished gliding board or snowboard has sidecut radii which are substantially smaller than those of the skis.

In this embodiment example, the central part serves as a stop for the skis. In those instances where the central part cannot assume this function due to its instability, suitable stops would have to be provided on the fittings or the skis would be fastened at the connection rods by means of the clamping clips 12. This also applies when no central part is provided.

Figure 11:
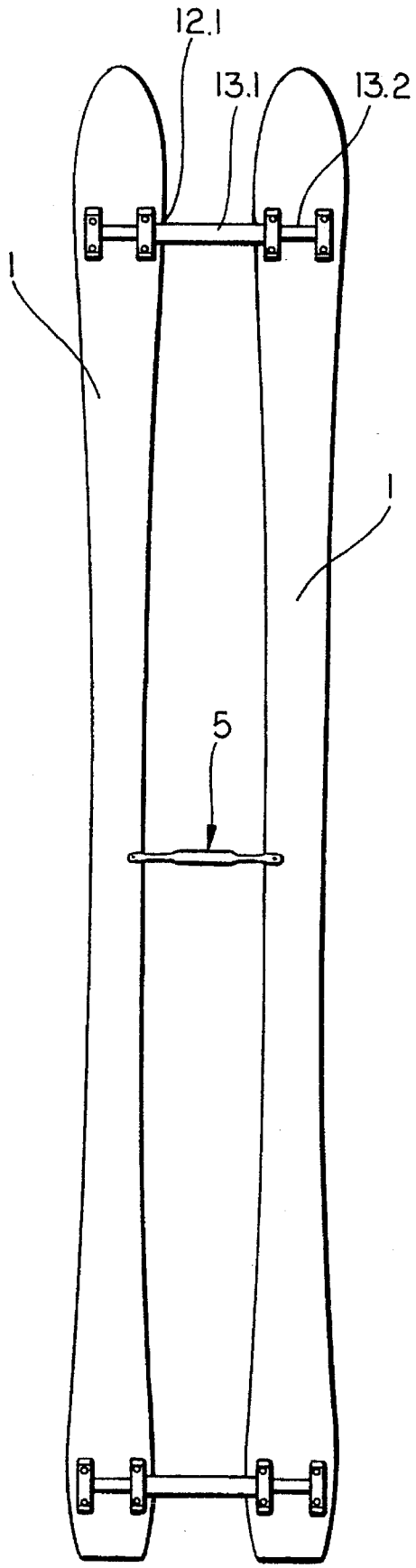
FIG. 11 illustrates a top view of a gliding board or snowboard assembled from two skis without a central part.
Figure 12:
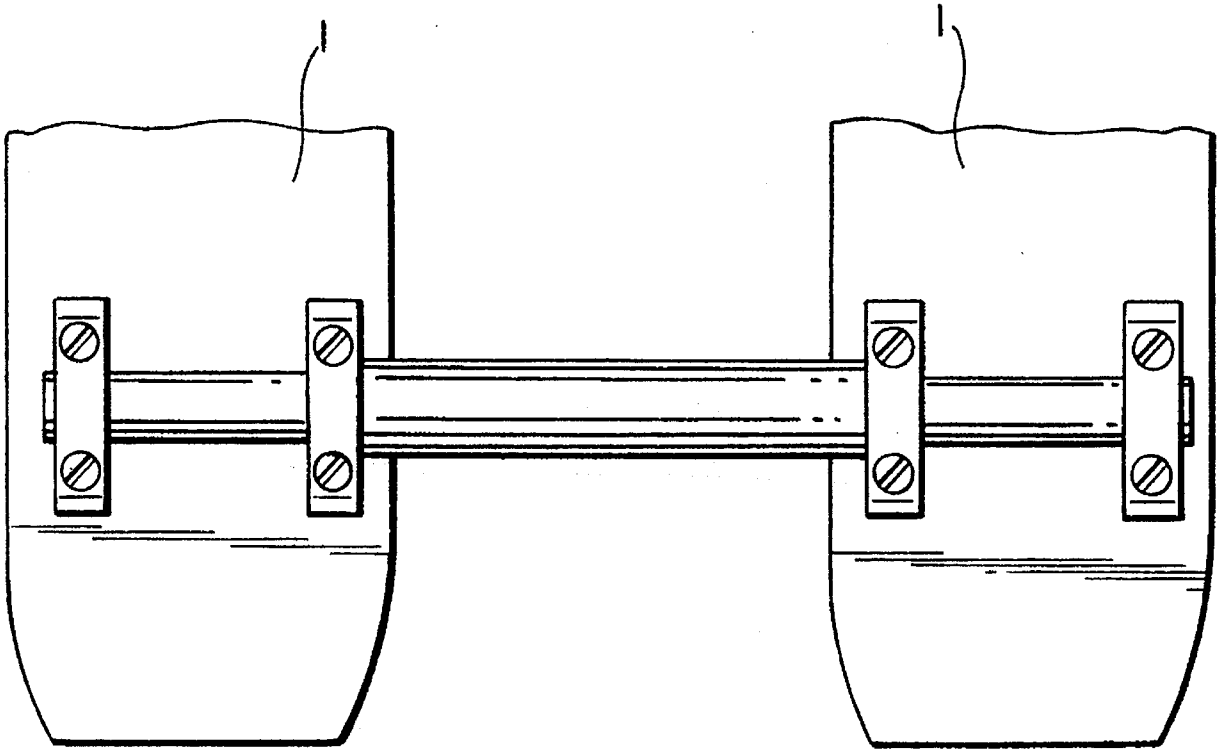
FIG. 12 illustrates a top view of the rear end of the gliding board according to FIG. 11.
Figure 13:
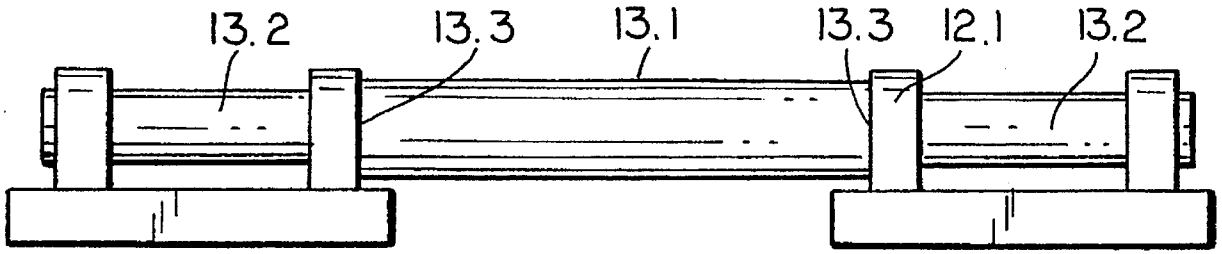
FIG. 13 illustrates a rear view of the gliding board according to FIG. 12.

FIGS. 11 to 13 show the construction of a gliding board or snowboard having two skis but no central part. Due to the lack of a central part, the two connection rods 13 are provided with a central portion 13.1 of increased diameter adjoined on both sides by portions 13.2 which are narrower in diameter. Accordingly, two shoulders 13.3 are formed. Clips 12.1 arranged on the skis contact these shoulders 13.3 when the skis are tightened against one another by the clamping means 5 in order to adjust a desired sidecut radius. Since the skis 1 are pressed against the shoulders 13.3 by the clamping means 5 it is not necessary for the clips 12.1 to be constructed as clamping clips. Thus, these clips only form a insertable connection which allows portions 13.2 to be displaced in the clips 12.1 but prevent a difference in height between the skis.

FIGS. 14 and 15 show an embodiment form in which the fittings are incorporated in the skis 1 and central part 2. As will be seen from FIGS. 14 and 15, the skis 1 and the central part 2 have thickened portions 19 and 20 in the end regions. The thickened portions 19 of the skis are provided with sleeves 21 for receiving a connection rod 13 so as to create a insertable connection which is displaceable in the horizontal direction. The connection rod 13 is securely inserted into the thickened portion 20 of the central part 2 so that it cannot fall out.

When the skis are tightened in the manner described above, they may undergo a deformation in the vertical direction so that the running surface of the snowboard formed in this way is convex. In order to obtain a flat running surface, the connection rod 13 can have two bent end portions **13*a* associated with the skis, as can be seen from FIG. 16, while the central portion 13*b* of the connection rod 13 associated with the central part 2 extends in a straight line. At the start of the clamping process, the skis 1 are at an angle to the central part 2 corresponding to the bending angle of the end portions 13*a* with respect to the central portion 13*b* of the connection rod 13. When the skis 1 deviate from their normal position during the clamping process this causes the connection rod 13 to be deformed due to the occurring forces. With a suitable selection of the bending angle of the end portions 13*a* it is possible for the occurring forces to deform the connection rod 13 until the connection rod 13 is straight in the clamped final state, resulting in a flat running surface of the gliding board snowboard as is shown in FIG. 17**.

In the embodiment examples described above, the skis 1 are arranged so as to be aligned with one another in the longitudinal direction resulting in a symmetrical gliding board or snowboard. There may be certain reasons for constructing an asymmetrical gliding board or snowboard For example, these reasons may stem from the fact that the arrangement of binding parts on the skis leads to problems since mounting plates are required and the binding parts must be mounted in the longitudinal direction of the skis when the skis are used individually and at an angle relative to the longitudinal direction when using touring skis for the construction of the gliding board or snowboard. Accordingly, the mounting plates might interfere with one another or with the fittings. In order to solve this problem, the skis are arranged so as to be somewhat offset relative to one another in the longitudinal direction in the assembled gliding board or snowboard, resulting in an asymmetrical gliding board or snowboard as shown in FIG. 18.

While the foregoing description and drawings represent the preferred embodiments of the present invention, it will be obvious to those skilled in the art that various changes and modifications may be made therein without departing from the true spirit and scope of the present invention.

What is claimed is:

1. In a gliding board having a form of a snowboard having a longitudinal axis, two touring skis, and fitting means for connecting the skis with one another, the improvement comprising clamping means for connecting the two skis at least in a central region thereof so that said two skis can be clamped together accompanied by a deformation of the ski in a direction transverse to the longitudinal axis, so that the gliding board in a clamped state has a substantially smaller sidecut radius than the individual skis when the individual skis are not clamped, and that fixed distances may be adjusted between the skis at least in tip regions of the skis and end regions of the skis.

2. The gliding board according to claim 1, wherein said fitting means can be selectively adjusted to define both a distance between the skis and a sidecut of the gliding board independently of the distance between the skis.

3. The gliding board according to claim 2, further including a central part, wherein said fitting means defines holes which are arranged in the region of the tips of the skis and in the region of the ends of the skis and includes connection rods which penetrate the holes, said connection rods being bent at an angle relative to the central part for interconnection with the skis.

4. The gliding board according to claim 2, wherein said fitting means defines holes which are arranged in the region of the tips of the skis and in the region of the ends of the skis and includes connection rods which penetrate the holes, wherein said connection rods, when inserted in the holes, prevent a difference in height between the skis when said skis are connected with one another but allow the distance between the individual skis to be adjusted freely.

5. The gliding board according to claim 4, wherein stops are provided on the connection rods for adjusting the distance between the skis.

6. The gliding board according to claim 4 wherein said fitting means are further constructed as clamps which clamp to the connection rods for adjusting the distance between the skis.

7. The gliding board according to claim 1, wherein a central part, having at least one part which is divided along one of transverse and longitudinal axes, is inserted between the two skis, said central part, with the exception of the regions associated with the tips and ends of the skis, being shaped in such a way that when the skis contact the central part at both tip and end regions there remains a gap between the central part and the skis, said gap being widest near the central regions of the skis.

8. The gliding board according to claim 7, wherein a shape of a front region of said central part mates with a shape of the tips of the skis and a shape of a rear region of the central part mates with a shape of the ends of the skis and in that a region located between the front region and the rear region is tapered.

9. The gliding board according to claim 7, wherein a shape of a front region of said central part mates with a shape of a tips of the skis and a shape of a rear region of said central part mates with a shape of the ends of the skis, and in that a region of the central part located between the front region and the rear region has parallel defining edges.

10. The gliding board according to claim 7, wherein connecting means are provided in central regions of the skis and said central part to prevent a difference in height between the ski and the central part in an assembled state but allow the distance between the skis and central part to be adjusted freely.

11. The gliding board according to claim 7, wherein said fitting means are embedded in at least one of the central part and the skis.

12. The gliding board according to claim 11, wherein connection rods are fastened to the central part.

13. The gliding board according to claim 7, wherein the central part serves as a spacer for the skis.

14. The gliding board according to claim 7, further including connection rods, wherein said central part has fittings for receiving said connection rods.

15. The gliding board according to claim 1, wherein said clamping means are formed by a clamping lock.

16. The gliding board according to claim 1, wherein the skis are arranged so as to be offset relative to one another in the longitudinal direction.

17. In a gliding board having a form of a snowboard having a longitudinal axis, two touring skis, and fitting means for connecting the skis with one another, the improvement comprising clamping means for connecting the two skis at least in a central region thereof so that said two skis can be clamped together accompanied by deformation of the skis in a direction transverse to the longitudinal axis so that fixed distances may be adjusted between the skis at least in tip regions of the skis and end regions of the skis by said fitting means wherein:

said fitting means can be selectively adjusted to define both a distance between the skis and to define a sidecut of the gliding board independently of a distance between the skis;

said fitting means defines holes which are arranged in the region of the tips of the skis and in the region of the ends of the skis and includes connection rods which penetrate the holes, such that said connection rods, when inserted in the holes, prevent a difference in height between the skis when said skis are connected with one another but allow the distance between the individual skis to be adjusted freely; and said fitting means are further constructed as clamps which clamp to the connection rods for adjusting the distance between the skis.

* * * * *